US007121763B1

(12) United States Patent
Young et al.

(10) Patent No.: US 7,121,763 B1
(45) Date of Patent: Oct. 17, 2006

(54) FOLDING END GATE FOR SCREED ASSEMBLY

(75) Inventors: Billy C. Young, Flat Rock, AL (US); David Swearingen, Ooltewah, TN (US)

(73) Assignee: Roadtec, Inc., Chattanooga, TN (US)

( * ) Notice: Subject to any disclaimer, the term of this patent is extended or adjusted under 35 U.S.C. 154(b) by 0 days.

(21) Appl. No.: 10/938,148

(22) Filed: Sep. 10, 2004

(51) Int. Cl.
*E01C 19/18* (2006.01)

(52) U.S. Cl. ..... 404/118

(58) Field of Classification Search ..... 404/84.1, 404/84.2, 90, 92, 96, 101–106, 118–120
See application file for complete search history.

(56) References Cited

U.S. PATENT DOCUMENTS

| | | | | | |
|---|---|---|---|---|---|
| 3,309,971 | A | * | 3/1967 | Domenighetti | 404/118 |
| 3,625,121 | A | | 12/1971 | Blumer | |
| 3,680,451 | A | | 8/1972 | Birtchet | |
| 4,068,969 | A | | 1/1978 | Beach et al. | |
| 4,145,154 | A | | 3/1979 | Mingot | |
| 4,181,449 | A | * | 1/1980 | Lenker | 404/87 |
| 4,379,653 | A | * | 4/1983 | Brown | 404/118 |
| 4,407,605 | A | | 10/1983 | Wirtgen | |
| 4,702,642 | A | * | 10/1987 | Musil | 404/118 |
| 4,718,790 | A | | 1/1988 | Layton | |
| 4,765,772 | A | | 8/1988 | Benedetti et al. | |
| 4,818,140 | A | * | 4/1989 | Carlson | 404/118 |
| 4,948,292 | A | * | 8/1990 | Haven et al. | 404/84.2 |
| 5,096,331 | A | * | 3/1992 | Raymond | 404/118 |
| 5,114,267 | A | * | 5/1992 | Smith et al. | 404/83 |
| 5,203,642 | A | * | 4/1993 | Heller et al. | 404/118 |
| 5,259,693 | A | | 11/1993 | Raymond | |
| 5,405,214 | A | | 4/1995 | Campbell | |
| 5,417,516 | A | | 5/1995 | Birtchet | |
| 5,452,966 | A | | 9/1995 | Swisher, Jr. | |
| 5,863,149 | A | | 1/1999 | Gustin | |
| 5,868,522 | A | * | 2/1999 | Campbell | 404/114 |
| 6,124,580 | A | | 9/2000 | Nottmeier et al. | |
| RE36,981 | E | | 12/2000 | Birtchet | |
| 6,203,243 | B1 | | 3/2001 | Birtchet | |
| 6,238,136 | B1 | | 5/2001 | Sovik et al. | |
| 6,318,928 | B1 | | 11/2001 | Swearingen | |
| 6,334,735 | B1 | | 1/2002 | Williams et al. | |
| 6,421,594 | B1 | | 7/2002 | Erasmus | |
| 2002/0106243 | A1 | | 8/2002 | Rahn et al. | |
| 2005/0111914 | A1 | * | 5/2005 | Rahn et al. | 404/118 |

* cited by examiner

*Primary Examiner*—Gary Hartmann
(74) *Attorney, Agent, or Firm*—Chambliss, Bahner & Stophel,P.C.

(57) ABSTRACT

An end gate assembly for a screed for a paving machine, where the screed is provided with a screed hinge component, includes a frame having a frame hinge portion that is adapted to mate with the screed hinge component to form a hinge having a hinge axis about which the frame may pivot. In a preferred embodiment of the invention, the end gate has a pair of hinges. More specifically, the preferred end gate has a first frame portion having a first hinge portion and a second hinge portion. The first hinge portion is adapted to mate with the screed hinge component to form a first hinge having a first hinge axis about which the first frame portion may pivot. This preferred assembly also includes a second frame portion having a hinge member that is adapted to mate with the second hinge portion of the first frame portion to form a second hinge having a second hinge axis about which the second frame portion may pivot.

16 Claims, 5 Drawing Sheets

FOLDING END GATE FOR SCREED ASSEMBLY

FIELD OF THE INVENTION

The present invention relates generally to end gate assemblies adapted for use on the screed of an asphalt paving machine, and more particularly to an end gate that may be folded to present a compact profile for travel.

BACKGROUND AND DESCRIPTION OF THE PRIOR ART

A screed is generally towed behind an asphalt paving machine in order to establish the thickness, and to some extent the density, of a layer or mat of asphalt which has been applied to a base surface to produce a roadway or parking lot. The free-floating paver screed, which is in common use today, is attached to the tractor of a paving machine at only one point on each side of the machine (the tow or pull point) to average out differences in grade that are encountered across the width of the paving machine. Typical screeds in common use are 8 feet (2.44 meters) in width, although screed extensions or cut-off shoes can be attached to the screed to increase or reduce the width of the asphalt mat that is applied by the paving machine. An end gate (also known as an end plate or edger plate) is attached to each outer end of the screed to restrict the outward movement of asphalt around the end of the screed and to provide additional control of the width of the asphalt mat that is applied. Under some circumstances, the elevation of the end gate may be set so as to allow some mix to bleed out under the end gate, and vertically adjustable end gates are described in U.S. Pat. No. 3,680,451 of Birtchet and in U.S. Pat. No. 6,238,136 of Sovik et al.

It is also known to remove end gates or to pivot them out of the way in order to install screed extensions or other attachments. U.S. Pat. No. 4,068,969 of Beach et al. describes a gutter attachment for a screed assembly which may be installed either after removal of the end gate or after pivoting a modified end gate out of the way.

Typical end gates may increase the width of the paving machine by more than six inches on each side. Since the width limit for transporting a paving machine on U.S. highways is 8.5 feet (2.59 meters), it is generally necessary to remove the end gates from a standard eight-foot screed before the machine can be transported. Because end gates are subjected to considerable forces by the asphalt being applied, they typically weigh as much as 300 pounds (136.2 kilograms) each. Consequently, one man cannot remove an end gate in order to prepare a paving machine for travel without the assistance of a crane or other lifting device. In addition, once removed, the end gates must be stored on the paving machine or on another vehicle during transport of the paving machine.

It would be desirable, therefore, if an end gate could be provided that can be easily manipulated to permit the paving machine to be transported on U.S. highways. It would also be desirable if such an end gate could be provided that does not have to be removed from an eight-foot screed on a paving machine in order to transport the machine on U.S. highways.

ADVANTAGES OF THE INVENTION

Accordingly, it is an advantage of the invention claimed herein to provide an end gate for a paving screed that can be easily manipulated to permit the paving machine to be transported on U.S. highways. It is another advantage of the invention to provide an end gate that does not have to be removed from an eight-foot screed on a paving machine in order to transport the machine on U.S. highways.

Additional advantages of the invention will become apparent from an examination of the drawings and the ensuing description.

SUMMARY OF THE INVENTION

The invention comprises an end gate assembly for a screed for a paving machine, where the screed is provided with a screed hinge component. The end gate assembly includes a frame having a frame hinge portion that is adapted to mate with the screed hinge component to form a hinge having a hinge axis about which the frame may pivot. In a preferred embodiment of the invention, the end gate has a pair of hinges. This embodiment includes a first frame portion having a first hinge portion and a second hinge portion. The first hinge portion is adapted to mate with the screed hinge component to form a first hinge having a first hinge axis about which the first frame portion may pivot. This preferred assembly also includes a second frame portion having a hinge member that is adapted to mate with the second hinge portion of the first frame portion to form a second hinge having a second hinge axis about which the second frame portion may pivot.

In order to facilitate an understanding of the invention, the preferred embodiment of the invention is illustrated in the drawings, and a detailed description thereof follows. It is not intended, however, that the invention be limited to the particular embodiment described or to use in connection with the screed illustrated herein. Various modifications and alternative embodiments such as would ordinarily occur to one skilled in the art to which the invention relates are also contemplated and included within the scope of the invention described and claimed herein.

EXPLANATION OF TECHNICAL TERMS

As used herein, the term "asphalt" refers to a bituminous paving mixture that is comprised of a binder and any of various aggregate materials, and which is used for paving purposes.

As used herein, the term "asphalt mat" refers to a layer of asphalt such as is applied by an asphalt paving machine to produce a roadway, parking lot or similar surface.

As used herein, the term "screed" refers to a device that is generally used in connection with an asphalt paving machine in order to establish the thickness, and to some extent the density, of an asphalt mat.

As used herein, the term "behind the screed" refers to the side of the screed that is at the rear when the screed is pulled or towed by a paving machine in connection with the application of an asphalt mat.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENT OF THE INVENTION

Figures 1, 2:
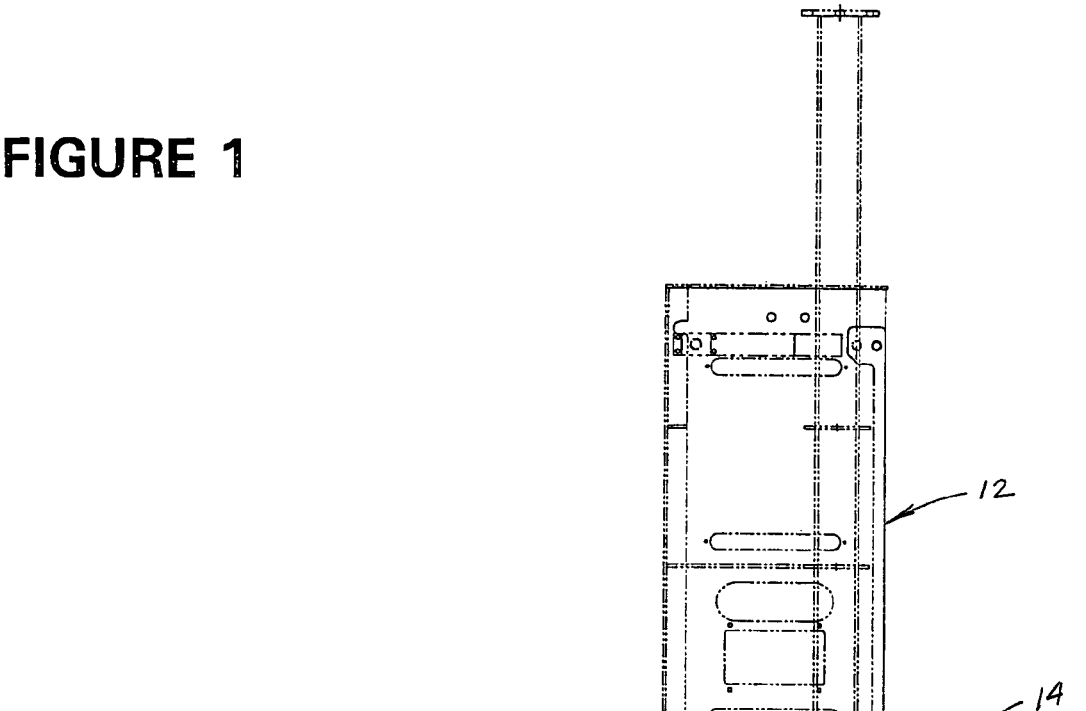
FIG. 1 is a top view of a portion of a screed and the components of a preferred embodiment of the invention.
FIG. 2 is a side view of the preferred embodiment of the invention showing its attachment to a screed.

As shown in the drawings, the invention comprises an improved end gate assembly, such as left side end gate assembly 10, which is attached to the outer end of a screed of a paving machine to restrict the outward movement of asphalt around the end of the screed and to provide additional control of the width of the asphalt mat that is applied. Because preferred left side end gate assembly 10 is substantially a mirror image of right side end gate assembly 110 (shown in FIGS. 3–6), only preferred left side end gate assembly 10 (best shown in FIGS. 1 and 2) will be described in detail. It should be understood that the following description of preferred left side end gate assembly 10 is also applicable to preferred right side end gate assembly 110.

FIGS. 1 and 2 illustrate preferred left side end gate assembly 10 and a portion of screed 12 to which the preferred left side end gate assembly may be attached. Screed 12 is generally conventional in configuration, except for the addition of a left side screed hinge component 14 comprised of hinge brackets 16 and 18 (shown in FIG. 2). Left side end gate assembly 10 includes left side first frame portion 20 having left side first hinge portion 22 and a left side second hinge portion 24. Left side first hinge portion 22 is adapted to mate with hinge component 14 of screed 12 by the insertion of hinge pin 26 into hole 28 of first hinge portion 22, hole 30 of bracket 16 and another similarly aligned hole (not shown) in bracket 18. The mating of left side screed hinge component 14 with left side first hinge portion 22 forms left side first hinge 32 (best shown in FIGS. 3–6) having a left side first hinge axis 34 (best shown in FIG. 2) about which the left side first frame portion may pivot. Preferably, hinge axis 34 is a vertical axis (as shown in the drawings), although other arrangements and orientations of hinge 32 are also contemplated within the scope of the invention. Hinge pin 26 also includes top plate 36 having a hole through which bolt 38 may be inserted to fasten the top plate onto first hinge portion 22. Preferably, as shown in FIG. 2, bolt 38 is adapted to be threaded into threaded hole 40 in bracket 16.

Left side end gate assembly 10 also includes left side second frame portion 42 having left side hinge member 44 that is adapted to mate with left side second hinge portion 24 to form a left side second hinge 46 (best shown in FIGS. 3–6) having a left side second hinge axis 48 (see FIG. 2) about which the left side second frame portion may pivot. It is preferred that hinge axis 48 is a vertical axis (as shown in the drawings), although other arrangements and orientations of hinge 46 are also contemplated within the scope of the invention. As shown in FIGS. 1 and 2, end 50 of left side second frame portion 42 is preferably inserted into retaining bracket 52 of end gate plate 54. Also attached to end gate plate 54 is end gate shoe 56 which preferably includes an upwardly slanted portion 58 at its forward end.

As best shown in FIG. 2, preferred end gate assembly 10 includes a pair of end gate adjustment jacks 60 and 62 which are adapted to adjust the elevation of the end gate shoe with respect to left side second frame portion 42. This preferred adjustment mechanism permits the application of a downward force sufficient to maintain contact between the end gate shoe and the top surface of the base or adjacent asphalt mat regardless of the thickness of the asphalt mat being applied by the paving machine. In addition, the preferred adjustment jacks may be configured to permit the shoe to be deflected under certain circumstances. Preferred end gate adjustment jacks 60 and 62 include upper portions 64 and 65 which are supported on intermediate plate 66, and lower portions 67 and 68. Jacks 60 and 62 include threaded rods (not shown) to which handles 70 and 72 are attached, which rods are adapted to mate with fixed nuts (also not shown) inside the jacks. The threaded rods rotate as the handles are turned to raise or lower the lower portions of the jacks with respect to the upper portion. Located beneath the intermediate plate are springs 74 and 76, which in cooperation with the rotating threaded rods, are adapted to provide a downwardly directed force to the end gate shoe. In the alternative, other means of applying a downwardly directed force may be employed, or the end gate assembly may be of sufficient mass and weight to provide the downwardly directed force required to maintain the end gate shoe in direct contact with the base or the adjacent asphalt mat.

FIGS. 3–6 illustrate the operation of the preferred embodiment of the invention illustrated in FIGS. 1 and 2. As shown in FIGS. 3–6, preferred left side end gate assembly 10 and preferred right side end gate assembly 110 are attached on opposite sides of screed 112, which is adapted to be pulled or towed by a paving machine in the direction indicated by arrow 113. Screed 112 is generally conventional in configuration, except for the addition of a left side screed hinge component 114 and a right side screed hinge component 116.

Left side end gate assembly 10 includes left side first frame portion 20 having left side first hinge portion 22 and a left side second hinge portion 24. Left side first hinge portion 22 is adapted to mate with hinge component 114 of screed 112 to form left side first hinge 32 having a left side first hinge axis 34 (not shown in FIGS. 3–6) about which the left side first frame portion may pivot. Left side end gate assembly 10 also includes left side second frame portion 42 having left side hinge member 44 that is adapted to mate with left side second hinge portion 24 to form a left side second hinge 46 having a left side second hinge axis 48 (not shown in FIGS. 3–6) about which the left side second frame portion may pivot. End gate plate 54 is attached to left side second frame portion 42 and end gate shoe 56 is attached to end gate plate 54.

Similarly, right side end gate assembly 110 includes right side first frame portion 120 having right side first hinge portion 122 and a right side second hinge portion 124. Right side first hinge portion 122 is adapted to mate with hinge component 116 of screed 112 to form right side first hinge 132 having a right side first hinge axis (not shown in FIGS. 3–6, but similar to left side first hinge axis 34) about which the right side first frame portion may pivot. Right side end gate assembly 110 also includes right side second frame portion 142 having right side hinge member 144 that is adapted to mate with right side second hinge portion 124 to form a right side second hinge 146 having a right side second hinge axis (not shown in FIGS. 3–6, but similar to left side second hinge axis 48) about which the right side second frame portion may pivot. End gate plate 154 is attached to right side second frame portion 142 and end gate shoe 156 is attached to end gate plate 154.

Figure 3:
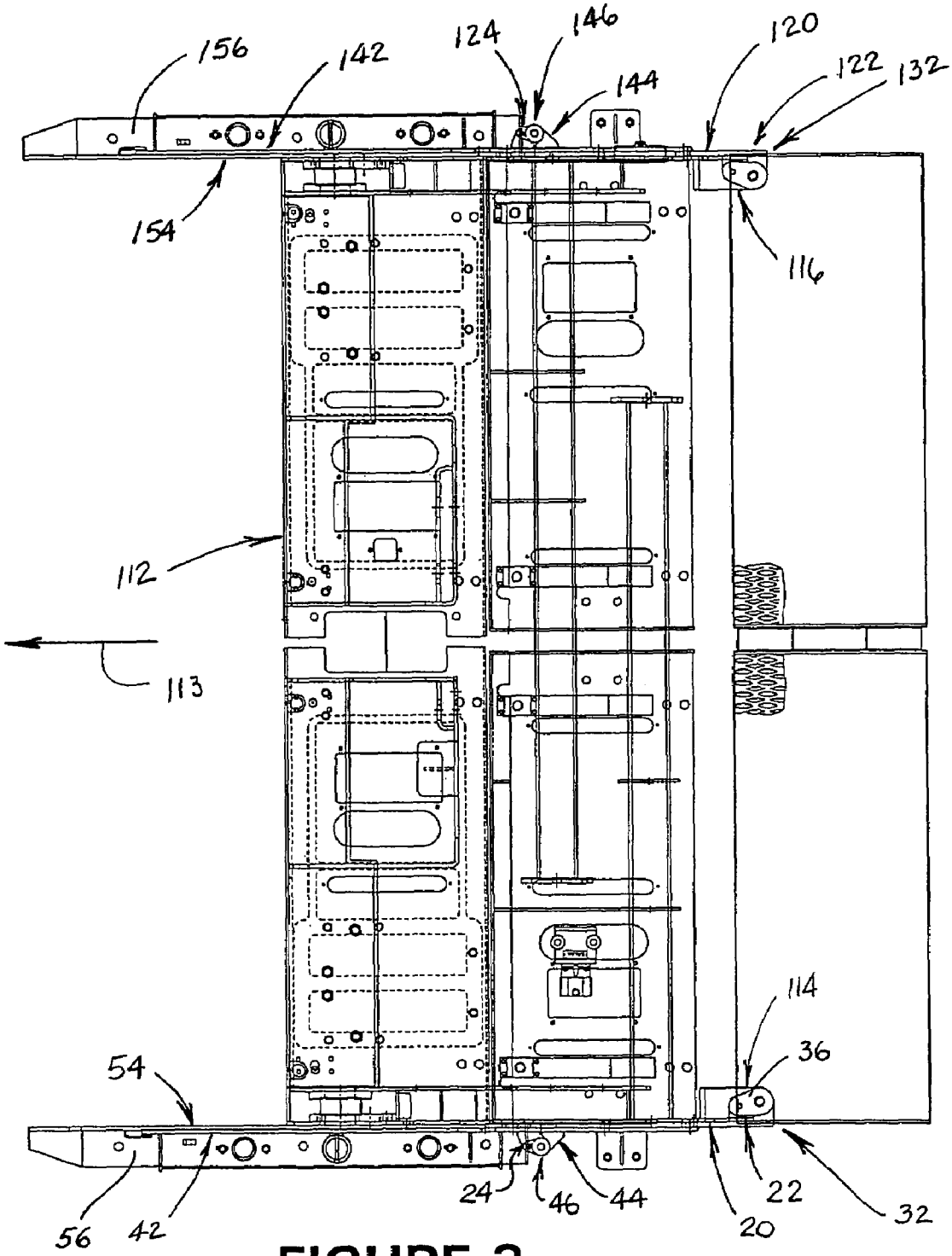
FIG. 3 is a top view of a screed which includes a preferred embodiment of the invention, showing the end gate assemblies in their operating positions.

FIG. 3 shows the preferred end gate assemblies 10 and 110 with their first frame portions in their operating positions, namely with left side first frame portion 20 and right side first frame portion 120 disposed alongside screed 112, and with their second frame portions in their first positions, namely with left side second frame portion 42 aligned with left side first frame portion 20 and with right side second frame portion 142 aligned with right side first frame portion 120. Referring again to FIG. 1, bolt 80 is passed through hole 82 in left side first frame portion 20 and through a hole in the left side of screed 12, and is secured to the screed by nut 84. Similarly, bolt 86 is passed through hole 88 in left side first frame portion 20 and through a hole in the left side of screed 12, and is secured to the screed by nut 90. In addition, bolt 92 is passed through hole 94 in left side second frame portion 42 and through a hole in the left side of screed 12, and is secured to the screed by nut 96. These bolts 80, 86 and 92 provide the preferred means for securing left side end gate assembly in the operating position shown in FIG. 3. When it is desired to move the end gate assembly to its travel position, one worker can remove these bolts and manipulate the preferred frame sections of the assembly without the assistance of a crane or other lifting device.

Figure 4:
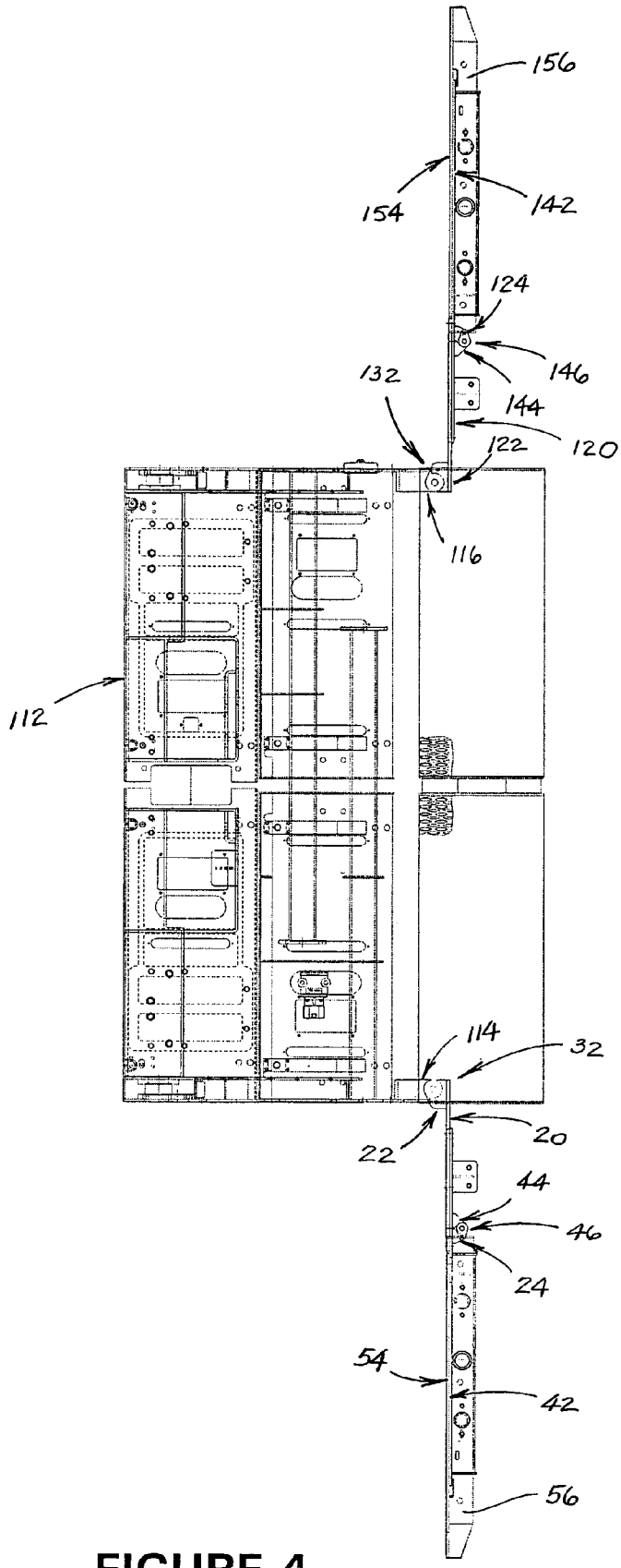
FIG. 4 is a top view of the screed of FIG. 3, showing the end gate assemblies in a first intermediate position between their operating positions and their travel positions.
Figure 5:
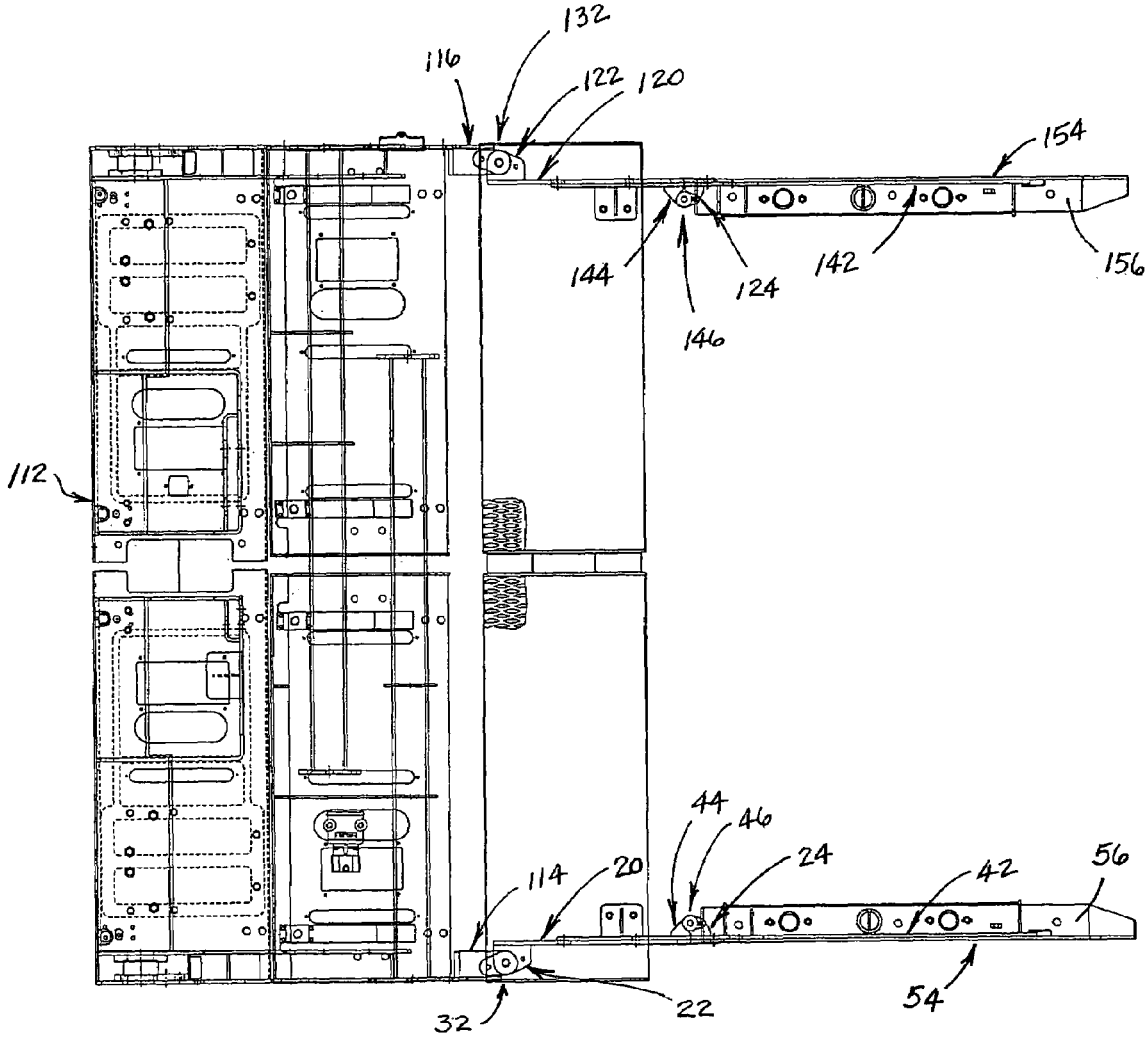
FIG. 5 is a top view of the screed of FIGS. 3 and 4, showing the end gate assemblies in a second intermediate position between their operating positions and their travel positions.

FIG. 4 shows the preferred end gate assemblies in a first intermediate position in which the left side and right side first frame portions have been pivoted about their first hinge axes through an arc of approximately 90° to an intermediate position, while the left side and right side second frame portions have remained in the same first positions, with respect to the attached first frame portions, as in FIG. 3. FIG. 5 shows the preferred end gate assemblies in a second intermediate position in which the first frame portions have been pivoted through an arc of approximately 180° to their travel positions, while the left side and right side second frame portions have remained in the same first positions, with respect to the attached first frame portions, as in FIGS. 3 and 4. In the configuration illustrated in FIG. 5, the end gate assemblies have been pivoted to a travel position in which the frame components are disposed generally behind the screed. With the first frame portions remaining in their travel positions, FIG. 6 shows the second frame portions of the preferred end gate assemblies having been pivoted from their first positions in which they are generally aligned with the first frame portions to their second positions in which the second frame portions are adjacent to the screed.

Although the sequence of manipulations of the preferred end gate assemblies that are illustrated by viewing FIGS. 3–6 sequentially may be preferred, it is also contemplated that the second frame portions may be pivoted about their pivot axes before the first frame portions reach the positions illustrated in FIG. 5. It is also contemplated that the first and second frame portions may be pivoted simultaneously through at least a portion of their pivoting motions about their respective pivot axes.

Figure 6:
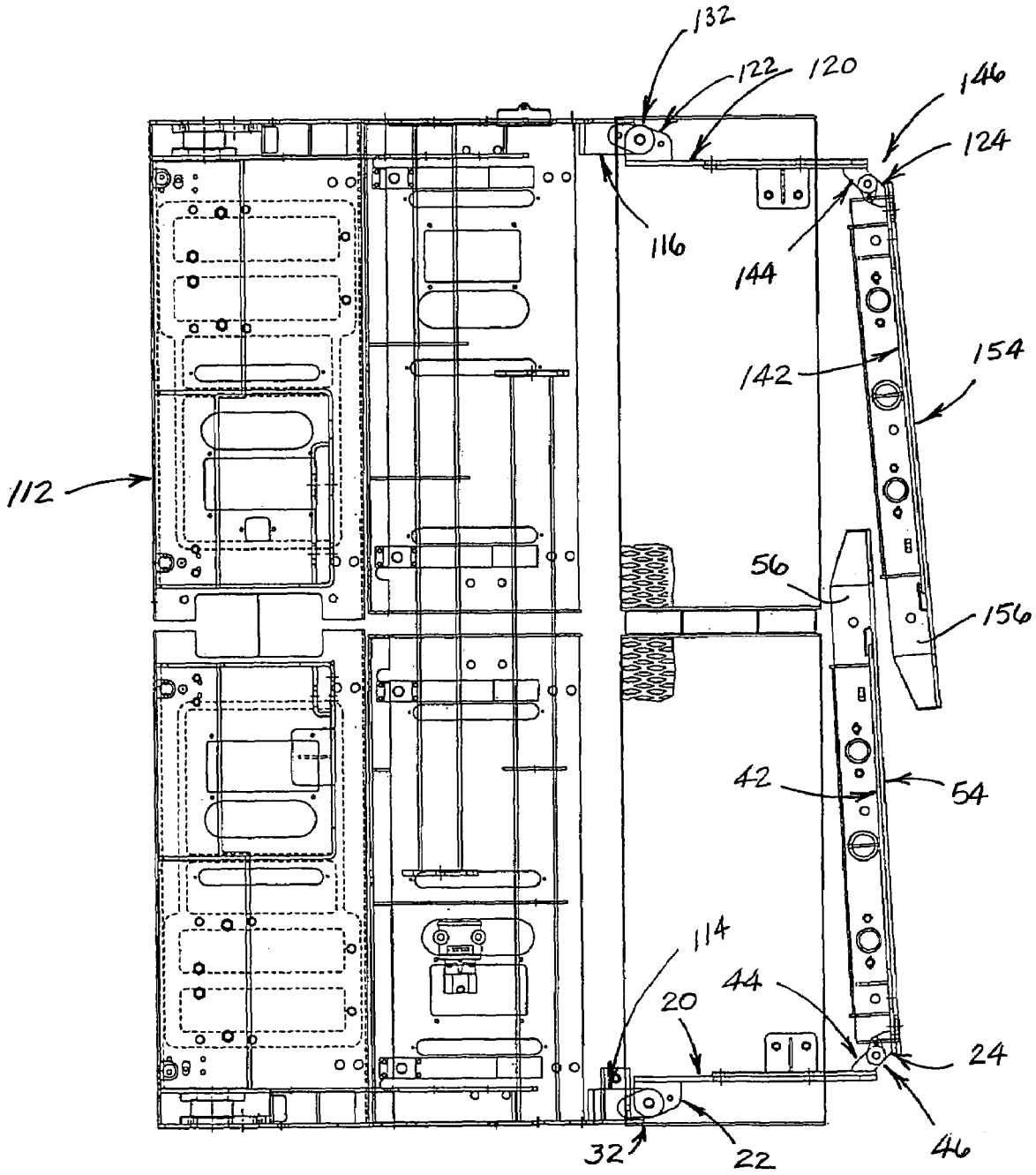
FIG. 6 is a top view of the screed of FIGS. 3–5, showing the end gate assemblies in their travel positions.

By providing the preferred end gate assemblies with pivoting connections, one worker can move the end gate assemblies from the position shown in FIG. 3 to that of FIG. 6, without requiring the assistance of a crane or other lifting machinery. All that is required is that retaining bolts 80, 86 and 92 (see FIG. 1) be removed, and the end gates can be folded from an operating configuration to a travel configuration that does not increase the width of the screed beyond the maximum U.S. travel width. Furthermore, such travel configuration (shown in FIG. 6) does not increase the overall length of the paving machine by a significant amount.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations as would be understood by those having ordinary skill in the art to which the invention relates, and the same are intended to be comprehended within the meaning and range of equivalents of the appended claims.

What is claimed is:

1. An end gate assembly for a screed for a paving machine, said screed having a screed hinge component, wherein said end gate assembly comprises:

(a) a frame having a frame hinge portion that is adapted to mate with the screed hinge component to form a hinge having a hinge axis about which the frame may pivot;

(b) an end gate plate which is attached to the frame;

(c) an end gate shoe;

(d) an end gate adjustment jack for adjusting the elevation of the end gate shoe with respect to the frame.

2. The end gate assembly of claim 1 wherein the hinge axis is a generally vertical axis.

3. An end gate assembly for a screed for a paving machine, said screed having a screed hinge component, wherein said end gate assembly comprises a frame having a frame hinge portion that is adapted to mate with the screed hinge component to form a hinge having a hinge axis about which the frame may pivot, wherein the frame and the hinge are arranged so that the frame is adapted to pivot from an operating position in which the frame is disposed alongside the screed to a travel position in which the frame is disposed behind the screed, namely on the side of the screed that is at the rear when the screed is pulled or towed by a paving machine in connection with the application of an asphalt mat.

4. An end gate assembly for a screed of a paving machine, said screed having a screed hinge component, wherein said end gate assembly comprises:

(a) a first frame portion having a first hinge portion and a second hinge portion, said first hinge portion being adapted to mate with the screed hinge component to form a first hinge having a first hinge axis about which the first frame portion may pivot;

(b) a second frame portion having a hinge member that is adapted to mate with the second hinge portion of the first frame portion to form a second hinge having a second hinge axis about which the second frame portion may pivot.

5. The end gate assembly of claim 4 wherein the first frame portion and the first hinge are arranged so that the first frame portion is adapted to pivot from an operating position in which the first frame portion is disposed alongside the screed through an arc of approximately 180° to a travel position.

6. The end gate assembly of claim 5 wherein the second frame portion and the second hinge are arranged so that the second frame portion is adapted to pivot from a first position which is generally aligned with the first frame portion to a second position in which the second frame portion is adjacent to the screed.

7. The end gate assembly of claim 4 wherein the first hinge axis is a generally vertical axis.

8. The end gate assembly of claim 7 wherein the second hinge axis is a generally vertical axis.

9. An end gate assembly for a screed for a paving machine, said screed having a screed hinge component, wherein said end gate assembly comprises:

(a) a first frame portion having a first hinge portion and a second hinge portion, said first hinge portion being adapted to mate with the screed hinge component to form a first hinge having a generally vertical first hinge axis about which the first frame portion may pivot from an operating position in which the first frame portion is disposed alongside the screed through an arc of approximately 180° to a travel position;

(b) a second frame portion having a hinge member that is adapted to mate with the second hinge portion of the first frame portion to form a second hinge having a generally vertical second hinge axis about which the second frame portion may pivot from a first position that is generally aligned with the first frame portion through an arc of approximately 90° to a second position;

(c) an end gate plate that is attached to the second frame portion.

10. In a screed which is adapted to be used in connection with an asphalt paving machine, the improvement which comprises:

(a) a pair of screed hinge components;

(b) a pair of frames, each of which includes;

(i) a frame hinge portion that is adapted to mate with one of the screed hinge components to form a hinge having a hinge axis about which the frame may pivot;

(ii) a frame portion;

(iii) an end gate shoe;

(iv) an end gate adjustment jack for adjusting the elevation of the end gate shoe with respect to the frame portion;

wherein each frame and its associated hinge are arranged so that the frame is adapted to pivot from an operating position in which the frame portion is disposed alongside the screed to a travel position in which the frame is disposed behind the screed, namely on the side of the screed that is at the rear when the screed is pulled or towed by a paving machine in connection with the application of an asphalt mat.

11. The improvement of claim 10 wherein each of the hinge axes is a generally vertical axis.

12. In a screed which is adapted to be used in connection with an asphalt paving machine, the improvement which comprises:

(a) a right side screed hinge component;

(b) a right side first frame portion having a right side first hinge portion and a right side second hinge portion, said right side first hinge portion being adapted to mate with the right side screed hinge component to form a right side first hinge having a right side first hinge axis about which the right side first frame portion may pivot;

(c) a right side second frame portion having a right side hinge member that is adapted to mate with the right side second hinge portion to form a right side second hinge having a right side second hinge axis about which the right side second frame portion may pivot;

(d) a left side screed hinge component;

(e) a left side first frame portion having a left side first hinge portion and a left side second hinge portion, said left side first hinge portion being adapted to mate with the left side screed hinge component to form a left side first hinge having a left side first hinge axis about which the left side first frame portion may pivot;

(f) a left side second frame portion having a left side hinge member that is adapted to mate with the left side second hinge portion to form a left side second hinge having a left side second hinge axis about which the left side second frame portion may pivot.

13. The improvement of claim 12 wherein:

(a) the right side first frame portion and the right side first hinge are arranged so that the right side first frame portion is adapted to pivot from an operating position in which the right side first frame portion is disposed alongside the screed through an arc of approximately 180° to a travel position;

(b) the left side first frame portion and the left side first hinge are arranged so that the left side first frame portion is adapted to pivot from an operating position in which the left side first frame portion is disposed alongside the screed through an arc of approximately 180° to a travel position.

14. The improvement of claim 13 wherein:

(a) the right side second frame portion and the right side second hinge are arranged so that the right side second frame portion is adapted to pivot from a first position which is generally aligned with the right side first frame portion to a second position in which the right side frame portion is adjacent to the screed;

(b) the left side second frame portion and the left side second hinge are arranged so that the left side second frame portion is adapted to pivot from a first position which is generally aligned with the left side first frame portion to a second position in which the left side frame portion is adjacent to the screed.

15. The improvement of claim 12 wherein:

(a) the right side first hinge axis is a generally vertical axis;

(b) the left side first hinge axis is a generally vertical axis.

16. The improvement of claim 15 wherein:

(a) the right side second hinge axis is a generally vertical axis;

(b) the left side second hinge axis is a generally vertical axis.

* * * * *